US009205970B2

(12) United States Patent
Rahm et al.

(10) Patent No.: US 9,205,970 B2
(45) Date of Patent: Dec. 8, 2015

(54) APPLICATION DEVICE FOR MULTI-COMPONENT SUBSTANCES, A CARTRIDGE SET AND A PACKAGING UNIT

(71) Applicant: SIKA TECHNOLOGY AG, Baar (CH)

(72) Inventors: Markus Rahm, Volketswil (CH); Christian Schultheiss, Pfäffikon (CH); Andreas Hiemer, Schübelbach (CH); Manuel Buck, Gebenstorf (CH)

(73) Assignee: SIKA TECHNOLOGY AG, Baar (CH)

( * ) Notice: Subject to any disclaimer, the term of this patent is extended or adjusted under 35 U.S.C. 154(b) by 57 days.

(21) Appl. No.: 13/925,327

(22) Filed: Jun. 24, 2013

(65) Prior Publication Data

US 2013/0277393 A1 Oct. 24, 2013

Related U.S. Application Data

(63) Continuation of application No. PCT/EP2011/073390, filed on Dec. 20, 2011.

(30) Foreign Application Priority Data

Dec. 24, 2010 (EP) ..... 10196973

(51) Int. Cl.
*B65D 88/54* (2006.01)
*B65D 83/00* (2006.01)
(Continued)

(52) U.S. Cl.
CPC ..... *B65D 83/0022* (2013.01); *B05C 17/00503* (2013.01); *B05C 17/00553* (2013.01);
(Continued)

(58) Field of Classification Search
CPC ..... B05C 17/00509; B05C 17/00553; B05C 17/00566; B05C 17/00583; B05C 17/00503; B05C 17/00596; B05C 17/0103; B05C 17/00576; B65D 81/325; B65D 83/0022; B65D 83/0033; B65D 83/0072
USPC ..... 222/94, 105, 82, 83.5, 88, 136, 137, 222/145.1, 145.5, 145.6, 325, 326, 386
See application file for complete search history.

(56) References Cited

U.S. PATENT DOCUMENTS 4,871,090 A * 10/1989 Hoffmann ..... 222/81
5,033,650 A * 7/1991 Colin et al. ..... 222/137
(Continued)

FOREIGN PATENT DOCUMENTS

CN 101068627 A 11/2007
DE 296 02 751 U1 4/1996
(Continued)

OTHER PUBLICATIONS

International Search Report (PCT/ISA/210) issued on Mar. 29, 2010, by the European Patent Office as the International Searching Authority for International Application No. PCT/EP2011/073390.
(Continued)

*Primary Examiner* — Patrick M Buechner
(74) *Attorney, Agent, or Firm* — Buchanan Ingersoll & Rooney PC

(57) ABSTRACT

An application device for multi-component substances, such as adhesives or sealants, having at least two interconnected cartridge receiving devices for receiving replaceable cartridges containing components to be mixed. One cartridge has a rigid outside wall, including a drive device for expelling the components in predetermined quantity ratios through outlets with the aid of pistons. A mixing device, connected to the outlets, mixes the expelled components and discharges them in a mixed state. At least one of the cartridge receiving devices can be loaded with cartridges on the discharge side. At least one of the cartridge receiving devices supports a cartridge having a rigid outside wall. A cover adapter is provided on the discharge side on the at least two cartridge receiving devices, and a cartridge cover is provided to receive or attach the replaceable mixing device.

18 Claims, 6 Drawing Sheets

(51) Int. Cl.
*B05C 17/005* (2006.01)
*B05C 17/01* (2006.01)

(52) U.S. Cl.
CPC ..... *B05C17/00583* (2013.01); *B05C 17/00596* (2013.01); *B05C 17/00509* (2013.01); *B05C 17/00513* (2013.01); *B05C 17/0103* (2013.01)

(56) References Cited

U.S. PATENT DOCUMENTS

| | | | | | |
|---|---|---|---|---|---|
| 5,161,715 | A | | 11/1992 | Giannuzzi | |
| 5,184,757 | A | | 2/1993 | Giannuzzi | |
| 5,242,082 | A | | 9/1993 | Giannuzzi | |
| 5,577,637 | A | * | 11/1996 | Voss | 222/137 |
| 5,697,524 | A | * | 12/1997 | Sedlmeier | 222/82 |
| 5,819,988 | A | * | 10/1998 | Sawhney et al. | 222/137 |
| 5,875,928 | A | * | 3/1999 | Muller et al. | 222/82 |
| 5,897,028 | A | * | 4/1999 | Sauer | 222/82 |
| 5,918,772 | A | * | 7/1999 | Keller et al. | 222/145.6 |
| 6,012,610 | A | * | 1/2000 | Pauser et al. | 222/88 |
| 6,065,645 | A | * | 5/2000 | Sawhney et al. | 222/137 |
| 6,129,244 | A | * | 10/2000 | Horth | 222/94 |
| 6,352,177 | B1 | * | 3/2002 | Bublewitz et al. | 222/82 |
| 6,394,314 | B1 | * | 5/2002 | Sawhney et al. | 222/137 |
| 6,394,643 | B1 | | 5/2002 | Bublewitz et al. | |
| 6,769,574 | B1 | * | 8/2004 | Keller | 222/137 |
| 2007/0175921 | A1 | * | 8/2007 | Keller | 222/137 |
| 2007/0289996 | A1 | * | 12/2007 | Wheatcraft et al. | 222/137 |
| 2008/0187253 | A1 | * | 8/2008 | Willner et al. | 383/37 |
| 2008/0251535 | A1 | * | 10/2008 | Suchan et al. | 222/83 |
| 2009/0084815 | A1 | * | 4/2009 | Paetow et al. | 222/94 |
| 2009/0134186 | A1 | * | 5/2009 | Keller | 222/137 |
| 2009/0152300 | A1 | * | 6/2009 | Hayman et al. | 222/145.6 |
| 2010/0027918 | A1 | * | 2/2010 | Willner et al. | 383/37 |
| 2010/0102088 | A1 | * | 4/2010 | Keller | 222/137 |
| 2010/0108709 | A1 | * | 5/2010 | Frey | 222/1 |
| 2010/0200614 | A1 | * | 8/2010 | Von Rotz et al. | 222/145.5 |
| 2010/0252574 | A1 | * | 10/2010 | Busin | 222/137 |
| 2011/0108573 | A1 | * | 5/2011 | Stoeckli et al. | 222/87 |
| 2011/0138741 | A1 | * | 6/2011 | Stoeckli et al. | 53/167 |
| 2012/0199607 | A1 | * | 8/2012 | Keller | 222/145.5 |
| 2012/0279988 | A1 | * | 11/2012 | Hiemer | 222/82 |
| 2013/0277390 | A1 | * | 10/2013 | Buck et al. | 222/80 |
| 2013/0336083 | A1 | * | 12/2013 | Linne et al. | 366/279 |
| 2014/0110435 | A1 | * | 4/2014 | Pappalardo | 222/145.5 |
| 2014/0158717 | A1 | * | 6/2014 | Ettlin | 222/327 |
| 2014/0197204 | A1 | * | 7/2014 | Bublewitz et al. | 222/145.5 |
| 2014/0301153 | A1 | * | 10/2014 | Buck et al. | 366/130 |
| 2014/0301156 | A1 | * | 10/2014 | Rahm et al. | 366/184 |
| 2014/0346190 | A1 | * | 11/2014 | Buck | 222/137 |
| 2014/0346251 | A1 | * | 11/2014 | Schultheiss | 239/314 |
| 2015/0114986 | A1 | * | 4/2015 | Ngu et al. | 222/1 |
| 2015/0114995 | A1 | * | 4/2015 | DiSiro et al. | 222/143 |
| 2015/0136806 | A1 | * | 5/2015 | Jung et al. | 222/145.5 |

FOREIGN PATENT DOCUMENTS

| | | | |
|---|---|---|---|
| DE | 103 10 162 | A1 | 9/2004 |
| DE | 103 22 932 | A1 | 12/2004 |
| EP | 1 138 397 | A2 | 10/2001 |
| EP | 2 147 870 | A1 | 1/2010 |

OTHER PUBLICATIONS

Notification of the First Office Action issued Jul. 1, 2015 by the Chinese Patent Office in corresponding Chinese Patent Application No. 201180061700.6, and an English translation thereof (19 pages).

* cited by examiner

APPLICATION DEVICE FOR MULTI-COMPONENT SUBSTANCES, A CARTRIDGE SET AND A PACKAGING UNIT

RELATED APPLICATION(S)

This application claims priority as a continuation application under 35 U.S.C. §120 to PCT/EP2011/073390, which was filed as an International Application on Dec. 20, 2011 designating the U.S., and which claims priority to European Application 10196973.1 filed in Europe on Dec. 24, 2010. The entire contents of these applications are hereby incorporated by reference in their entireties.

FIELD

The disclosure relates to an application device for multi-component substances, such as multi-component adhesives or multi-component sealants, the device having at least two interconnected cartridge receiving devices for receiving replaceable cartridges containing substance components to be mixed, an expulsion device for expelling (e.g., simultaneously expelling) the substance components from the cartridges in predetermined quantity ratios through component outlets with the aid of expulsion pistons, and a mixing device, which is connected to the component outlets, mixes the expelled substance components and discharges them in the mixed state. The disclosure also relates to a cartridge set for use in the aforementioned application device and to a packaging unit composed of this application device and this cartridge set.

BACKGROUND INFORMATION

An application device is known from the published EP 1 138 397 A2, for example. This published document proposes a device for dispensing a pasty two-component mixture, the device being provided with a supply container having at least two chambers for each of the pasty components of the mixture, wherein the supply container has an outlet port for each chamber; a mixer unit having a tubular mixer housing with a mixer element arranged therein, wherein the mixer housing includes a coupling end, which can be coupled to the supply container and has two inlet ports, and two channels for the pasty components of the mixture leading to the mixer element, and further includes, at the opposite end, an outlet opening for the mixture, wherein the inlet ports can be inserted into the outlet ports, or vice versa, and a holding sleeve for the coupling end of the mixer housing, the sleeve being mounted rotatably on the supply container, wherein the holding sleeve surrounds the two outlet ports and has a cut-out, the shape of which at least in some sections is substantially identical to the cross-sectional shape of the coupling end of the mixer housing, wherein the holding sleeve can be rotated between a receiving rotational position, in which the cut-out is oriented in keeping with the orientation of the coupling end of the mixer housing when the inlet ports are connected to the outlet ports of the supply container, and a locking rotational position, in which at least a part of the cut-out edge of the holding sleeve extends over and into parts of the coupling end of the mixer housing.

This known application device can be difficult to handle, for example when replenishing the substance components and when using the device with only some of the filled-in substance components.

SUMMARY

An application device is disclosed for a multi-component substance, comprising: at least two interconnected cartridge receiving devices for receiving replaceable cartridges containing substance components to be mixed, one of the cartridges having a rigid outside wall; a drive device for simultaneously expelling the substance components from cartridges in predetermined quantity ratios through component outlets with expulsion pistons; a mixing device, which is connected to the component outlets, for mixing the expelled substance components and discharging them in a mixed state, wherein at least one of the cartridge receiving devices is configured to be loaded with cartridges on the discharge side; and wherein at least one of the cartridge receiving devices is configured with a rigid outside wall so as to mount a cartridge; a cover adapter provided on the discharge side on the at least two cartridge receiving devices; and a cartridge cover, which is configured to receive or attach the replaceable mixing device.

A cartridge set for loading an application device is also disclosed for a multi-component substance, the cartridge set comprising: a first cartridge, composed of a foil pouch containing a first substance component; a second cartridge, composed of a cylinder having a rigid outside wall, containing a second substance component; and an adapter piece that is rigidly connected to the first and second cartridges, wherein the adapter piece comprises: a first receptacle for the first cartridge; a second receptacle for the second cartridge; at least one connecting rib between the first and second receptacles; wherein the first receptacle has an opening for an opening device of the foil pouch.

A packaging unit is also disclosed, composed of an application device for multi-component, comprising: at least two interconnected cartridge receiving devices for receiving replaceable cartridges containing substance components to be mixed, one of the cartridges having a rigid outside wall; a drive device for expelling the substance components from cartridges in predetermined quantity ratios through component outlets with expulsion pistons; a mixing device, which is connected to the component outlets, for mixing the expelled substance components and discharging them in a mixed state, wherein at least one of the cartridge receiving devices is configured to be loaded with cartridges on the discharge side; and wherein at least one of the cartridge receiving devices is configured with a rigid outside wall so as to mount a cartridge; a cover adapter provided on the discharge side on the at least two cartridge receiving devices; a cartridge cover, which is configured to receive or attach the replaceable mixing device; and at least one cartridge set comprising: a first cartridge, composed of a foil pouch containing a first substance component; a second cartridge, composed of a cylinder having a rigid outside wall, containing a second substance component; an adapter piece that is rigidly connected to the first and second cartridges, wherein the adapter piece comprises: a first receptacle for the first cartridge; a second receptacle for the second cartridge; at least one connecting rib between the first and second receptacles; and wherein the first receptacle has an opening for an opening device of the foil pouch.

BRIEF DESCRIPTION OF THE DRAWINGS

The disclosure will be described hereafter in greater detail based on preferred exemplary embodiments with the aid of the figures, wherein features necessary to understand the disclosure are shown. Of course the disclosure is not limited to the exemplary embodiments that are shown and described. In the drawings.

DETAILED DESCRIPTION

Figure 1:
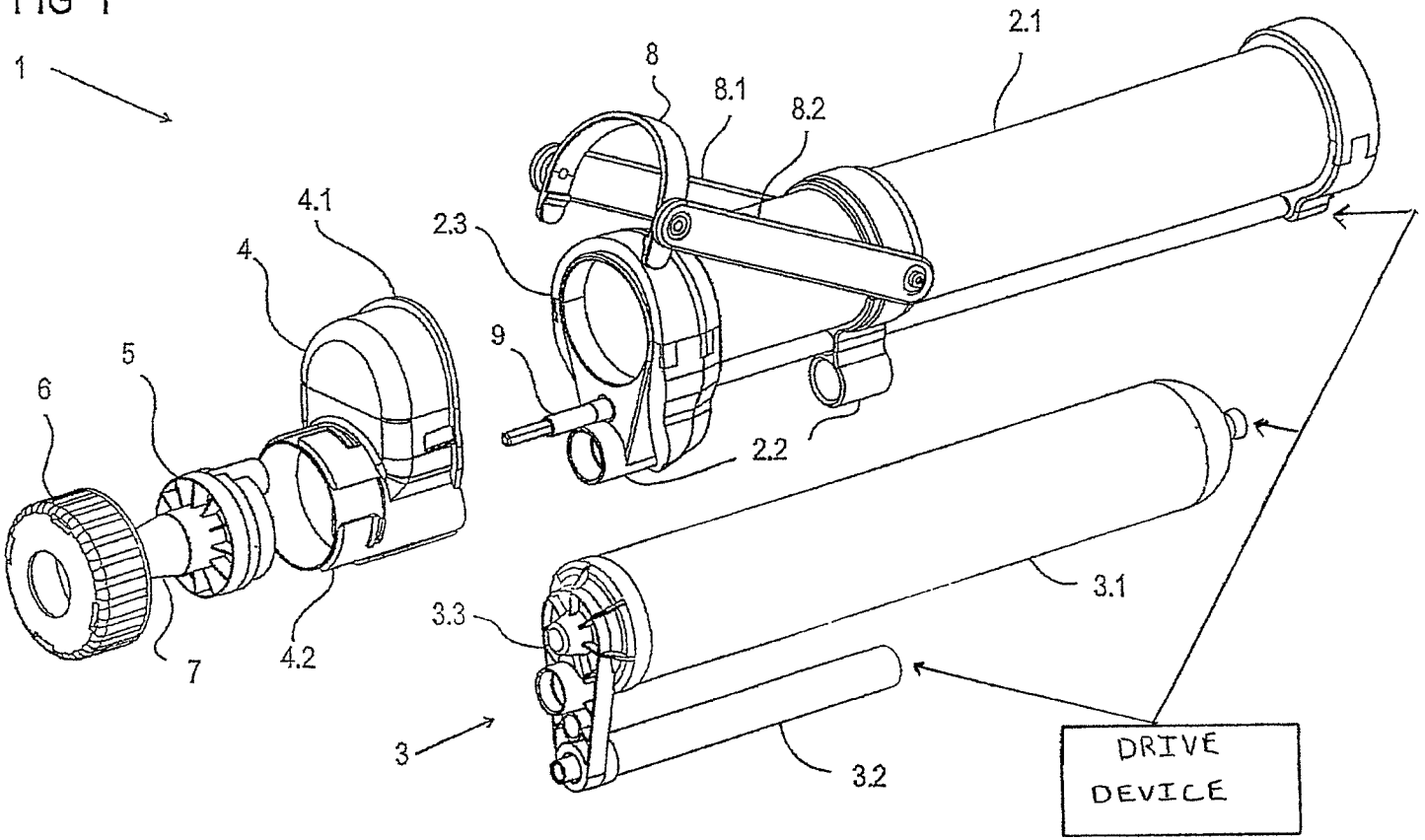
FIG. 1: shows an exemplary application device without drive, comprising a closure bracket.

Exemplary application devices for multi-component substances are disclosed that can improve handling when for example, replenishing substance components and/or when only some of the substance components are consumed.

The inventors found that the handling of such an application device can be significantly improved if the device can be loaded from the front, which is to say from the discharge side, at least with respect to one substance component, and for example with respect to all substance components. To this end, a cover adapter is present on the side of the cartridge receiving device of the application device, to which adapter a cartridge cover can be attached, which in turn can be attached to a mixing device. This configuration, among other things, allows the substance components to be replenished very easily, without requiring the cumbersome disassembly of an expulsion device for the substance components, which optionally has an electric drive with a complex gearbox. Because the mixer is easy to remove, the mixer, in which the previously mixed components have already cured, is simple to replace after only partial use of the substance components, and the application can be carried out with the remainder of the substance components.

Replenishment and cartridge sets designed according to the disclosure are also part of the disclosure, being composed of a combination of a first cartridge made of a cylindrical tube packaging containing a substance component, a second smaller cylindrical cartridge having a rigid outside wall, and a connecting element for the two cartridges, which is designed so that the entire package can be inserted from the front into the cartridge receiving devices and is immediately ready for use.

According to an exemplary aspect of the disclosure, the inventors propose an application device for multi-component substances, such as multi-component adhesives or multi-component sealants, having at least two interconnected cartridge receiving devices for receiving replaceable cartridges containing substance components to be mixed, an expulsion device for expelling (e.g., simultaneously expelling) the substance components from the cartridges in predetermined quantity ratios through component outlets with the aid of expulsion pistons, a mixing device, which is connected to the component outlets, which mixes the expelled substance components and discharges them in the mixed state, and wherein at least one of the cartridge receiving devices is designed to be loaded with cartridges on the discharge side, a cover adapter being provided on the discharge side on the at least two cartridge receiving devices, and a cartridge cover being provided, which is designed to receive or attach the replaceable mixing device.

In an exemplary embodiment, the mixing device can be an active mixer, wherein, for example, a drive shaft for the active mixer is provided, which drives the active mixer, for example based on the same electric drive that also performs the expulsion of the substance components. A gearbox may also be used for this purpose, which has several drive outputs, with one of the outputs being designed to drive the mixer. The cover adapter can have an aperture for the drive shaft from the gearbox to the active mixer. Likewise, the cartridge cover can have an aperture for this drive shaft to the active mixer. As an alternative, a passive mixer may also be used as the mixing device.

Exemplary embodiments of the application device according to the disclosure have a closure device, which securely fixes or keeps the cartridges that are inserted in the cartridge receiving devices.

In a first exemplary variant, a closure bracket can be provided for this purpose, which fixes the cartridge cover after the cartridge cover has been placed on the cover adapter. In an exemplary stable embodiment, the closure bracket can comprise two swivel pins, which are hinged in the region of a cartridge receiving device.

According to a second exemplary variant, a screw coupling is provided on the cover adapter, the coupling comprising a thread, which can engage with a mating thread, preferably a mating threaded segment, on the cartridge cover. It can be advantageous if the screw coupling has an external thread and the cartridge cover has an internal thread as the mating thread.

As an alternative to the screw coupling, it is also possible to use a bayonet catch, which has an engagement section that can be pivoted about a rotation angle and can engage in a mating piece on the cartridge cover.

According to a third exemplary embodiment, the cartridge cover can also be attached on the cover adapter so as to pivot about a swivel pin that is, for example, parallel to the longitudinal axes of the cartridge receiving devices, wherein the cartridge cover itself can comprise a closure mechanism, which is intended to prevent inadvertent opening of the cartridge cover. This may be a clip closure or a locking bar or the like, for example. It is also provided in an exemplary embodiment that a shaft displacement element is present, which can displace at least a part of the, optionally telescopic, drive shaft of an optionally present active mixer in the direction of the pin. This can considerably facilitate the use of an active mixer.

In another exemplary embodiment of the application device, the closure device is achieved by the cartridge cover having several elastic claws in the form of clip closures and the cover adapter having at least one corresponding mating piece, so that the claws can latchingly engage with the cover adapter when the cartridge cover is placed on.

To this end, a closure sleeve may additionally be provided, which can be pushed over the claws so as to secure the connection between the cover adapter and cartridge cover. It is favorable if the elastic claws are designed with an outward bend with no load applied, so that these latchingly engage only after the closure sleeve has been pushed on and automatically disengage again when the closure sleeve is pushed back and release the cartridge cover.

The cartridge cover can comprise a mixer adapter so as to easily attach the mixing device, wherein the mixing device can be inserted and attached in the mixer adapter. A bayonet catch or a turn lock can, for example, be used to attach the mixing device.

To an extent that is not to be underestimated, the simple handling of the application device for multi-component substances according to the disclosure, such as multi-component adhesives or multi-component sealants, lies in the simple loading of the substance components, wherein these can be arranged in accordance with the disclosure and be ready-for-use in a cartridge set or a refill set. For this purpose, the inventors propose that such a cartridge set comprise a first cartridge, composed of a foil pouch, such as a substantially cylindrical foil pouch, containing a first substance component, a second cartridge, composed of a cylinder containing a second substance component, and an adapter piece, the adapter piece comprising a first receptacle for the first cartridge, a second receptacle for the second cartridge, at least one connecting rib between the first and second receptacles, wherein the first receptacle has an opening for an opening device of the foil pouch.

If an active mixer may potentially be used, the adapter piece can, for example, have an aperture for a drive shaft.

In the cartridge set, the second receptacle can further have a central opening, through which a discharge spout of the second cartridge can be placed.

An exemplary arrangement of the cartridge set also exists where the centers of the opening for an opening device of the foil pouch, of the aperture for the drive shaft and the opening for the discharge spout of the second cartridge are arranged, in a projection from the front, on a straight line.

In addition, so as to avoid unnecessary free space, which could cause problems with metering accuracy, it can be favorable for the first receptacle to have a central bulge, which provides room for a closure piece of the foil pouch.

Within the scope of the present disclosure, a packaging unit is proposed, which can, for example, be composed of an application device for multi-component substances, such as multi-component adhesives or multi-component sealants as disclosed herein, and at least one cartridge set as disclosed herein.

FIG. 1 shows a first exemplary variant of an application device 1 according to the disclosure, with an option of loading the cartridge receiving devices 2.1 and 2.2 from the front or from the application side. This illustration shows the application device without the drive device, which is used to ultimately expel the substance components provided in the cartridge receiving devices 2.1 and 2.2. In the illustration, the exemplary application device 1 according to the disclosure comprises a first cartridge receiving device 2.1 for a foil pouch, while the cartridge receiving device 2.2, which can be essentially composed of two cylindrical support tubes, is provided for inserting a cylindrical cartridge, which has a rigid outside wall. According to an exemplary embodiment, the application device 1 can be designed so that a cartridge set 3, which is composed of a foil pouch 3.1 and a cartridge 3.2 having a rigid outside wall, is provided for loading the application device 1 with two different substance components. Both cartridges 3.1 and 3.2 are held together in the correct positioning with the aid of an adapter 3.3, so that the entire cartridge set 3 can be inserted into the cartridge receiving devices 2.1 and 2.2 in one handling step.

It shall be pointed out that the first cartridge receiving device of the application device can be specifically designed to receive a foil pouch, for example such as in the embodiment according to FIG. 1 as a self-supporting cylinder having a rigid outside wall, while the second cartridge receiving device can be designed for inserting a self-supporting cartridge having a rigid outside wall. The adapted receiving device can be used to retain and support such a cartridge in the front region and therefore does not, for example, comprise an (additional) cylinder that extends over the length of the cartridge. In addition, the adapter, which is already rigidly attached to the cartridges, exerts a certain supporting and retaining function for the cartridges.

Thereafter, the cartridge cover 4 is placed on the cover adapter 2.3, which has been attached at the front, and is locked to the cover flange 4.1 with the aid of a bracket 8, which is hinged to the cartridge receiving device 2.1 by way of two swivel pins 8.1 and 8.2, by folding down this locking bracket. The cover adapter 2.3 is designed such that, when an active mixer is used, as shown in FIG. 1, both the drive shaft 9 is guided through the adapter 3.3 and the cover 4 leaves sufficient space to connect the drive shaft 9 to the active mixer 5. When the cover 4 is attached to the cover adapter 2.3, the active mixer 5 can be inserted into the mixer adapter 4.2 of the cartridge cover 4. Previously, the two cartridges were opened, so that after actuation of the drive device, which is not shown here, the two substance components from the two cartridges 3.1 and 3.2 are supplied in the desired metered quantities to the active mixer 5, wherein the mixer is operated at the same time by the drive shaft 9. So as to attach the active mixer 5 to the cartridge cover 4, a bayonet catch 6 is provided in the present case, which is placed over the active mixer 5 and secures the mixer in the mixer adapter 4.2 of the cartridge cover 4. The active mixer 5 additionally can comprise an application tip 7, by way of which the mixed substance components from the cartridges 3.1 and 3.2 can be applied in the desired manner.

Figure 2:
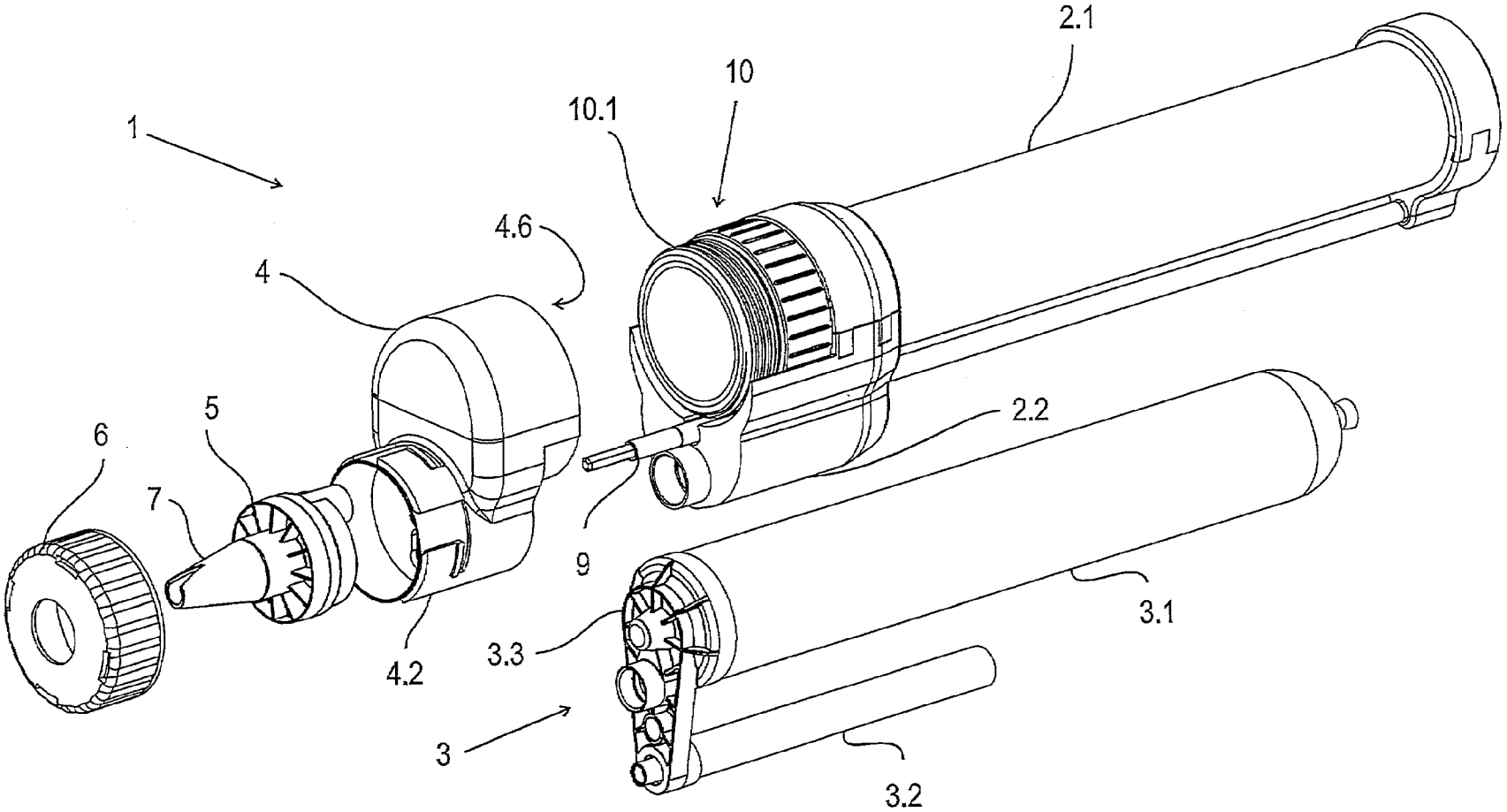
FIG. 2: shows an exemplary application device without drive, comprising a turn lock.

FIG. 2 likewise shows an exemplary application device 1 that can be loaded with a cartridge set 3 from the application side, wherein in this embodiment the cartridge cover 4 can be screwed to the cartridge receiving devices 2.1 and 2.2 with the aid of a screw coupling 10 having an external thread 10.1, wherein the cartridge cover 4 here has a threaded segment 4.6 on the inside, which is not visible and which is not completely closed, so that the cartridge set 3 can be inserted, while the cartridge cover 4 is screwed to the cartridge receiving devices 2.1 and 2.2 with the aid of the screw coupling 10.

It is apparent from the exemplary embodiment shown that, contrary to the embodiment of FIG. 1, the cartridge receiving device is a single cylindrical insert, however the insert being considerably longer than in the embodiment of FIG. 1. The attachment of the active mixer 5 shown here is achieved in a manner corresponding to that described for FIG. 1, wherein it shall be pointed out that according to the disclosure an active mixer does not necessarily have to be used, but passive mixers can also be employed in the application device 1 according to the disclosure.

Moreover, it is also possible to use a bayonet catch 6 instead of the screw coupling 10, which here has an external thread 10.1, the bayonet catch engaging on the opposite side in corresponding cut-outs of the cartridge cover 4 and securing the cartridge cover 4 to the cartridge receiving devices 2.1 and 2.2 by a rotation of several degrees. It shall also be pointed out that the bayonet catch 6 shown here can also be replaced with a turn lock, in which an appropriate external thread is provided on the mixer adapter 4.2 and the turn lock 6 has a matching internal thread.

Figure 3:
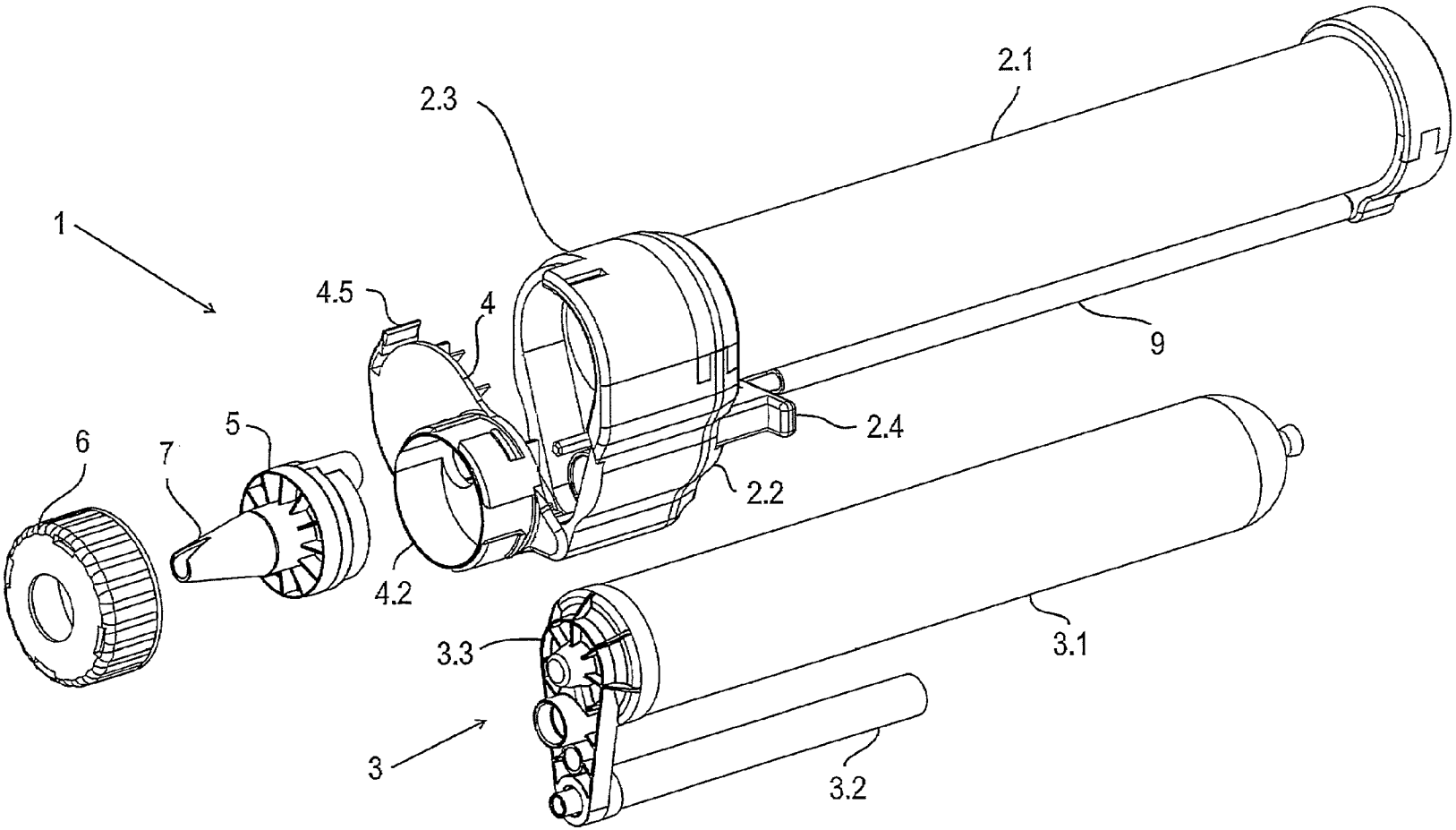
FIG. 3: shows an exemplary application device without drive, comprising a pivot closure.

Another exemplary variant of the application device 1 according to the disclosure is shown in FIG. 3. This application device 1 is also designed so that the cartridge set 3 can be loaded from the front, wherein for this purpose the design shown uses a cartridge cover 4 that, on one side, is hinged to the cover adapter 2.3 using a swivel pin (not visible) so that the cover 4 is pivoted out laterally about this swivel pin so as to open the application device 1. Thereafter, the cartridge set 3 can be inserted, and then the cartridge cover 4 can be pivoted over the inserted cartridge set 3 so as to close the set. A clip closure 4.5, which can latchingly engage on a mating piece on the cover adapter 2.3, is provided for securing the cartridge cover 4. When the application device 1, which here is shown with an active mixer 5, is operated, the drive shaft 9 is located between the two cartridge receiving devices 2.1 and 2.2, the drive shaft in a particularly exemplary embodiment—as shown here with the aid of a shaft displacement element 2.4—being able to be displaced toward the back with respect to the front end given the telescopic design, so that the cartridge cover 4 can be pivoted without difficulty. When the cartridge cover 4 is closed, the telescopic tip of the drive shaft 9 can again be pushed forward with the aid of the shaft displacement element 2.4, so that this tip can engage in the active mixer 5 as soon as the mixer is inserted into the mixer adapter 4.2.

Figure 5:
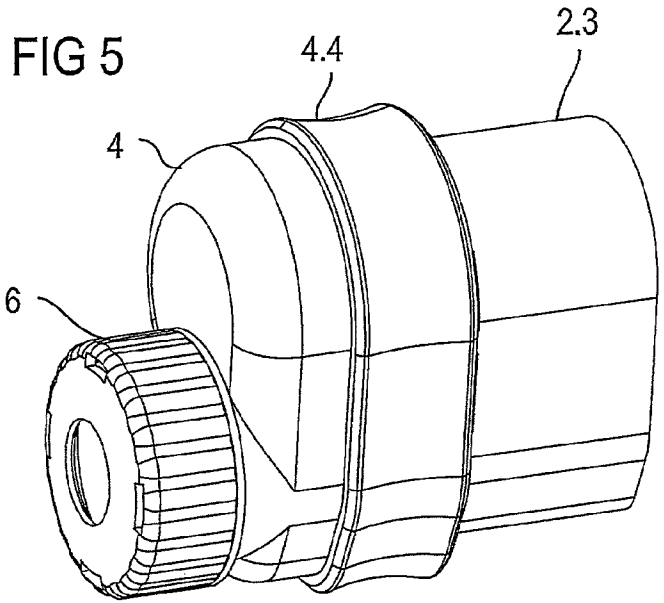
FIG. 5: shows an exemplary application device without drive, comprising a clip closure, which is closed.
Figure 4:
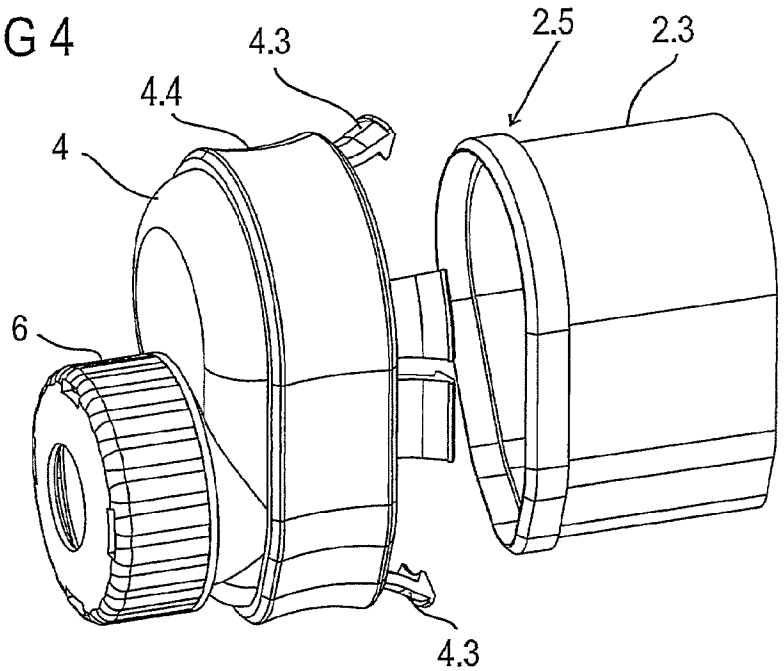
FIG. 4: shows an exemplary application device without drive, comprising a clip closure, which is open.
Figure 5A:
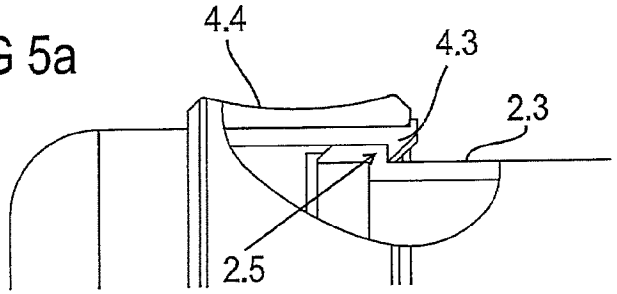
FIG. 5*a*: is a longitudinal sectional view in a region of the exemplary closure sleeve of FIG. 5.

FIGS. 4, 5 and 5*a* show yet another exemplary variant of an application device in the region of the cartridge cover, wherein the cartridge cover 4 comprises several claws 4.3 for the attachment to the cover adapter 2.3, the claws being able to engage with a mating piece 2.5 on the cover adapter 2.3 These claws can for example, be designed so that they automatically latchingly engage with this mating piece 2.5 when the cartridge cover 4 is placed on. However, in the embodiment shown, these are slightly bent to the outside, so that a latching engagement does not take place until the closure sleeve 4.4 is displaced to the right, the closure sleeve extending around the periphery of the cartridge cover 4 and allowing the claws 4.3 to latchingly engage with the mating piece 2.5 of the cover adapter 2.3 during a displacement to the right.

Such a situation, in which the closure sleeve 4.4 is pushed to the right or pushed to the back, is shown in FIG. 5.

The detailed illustration of FIG. 5*a* in particular shows a sectional view of how the claws 4.3 engage with the mating piece 2.5 on the side of the cover adapter 2.3 as a result of the closure sleeve 4.4 being pushed backward.

Figure 6:
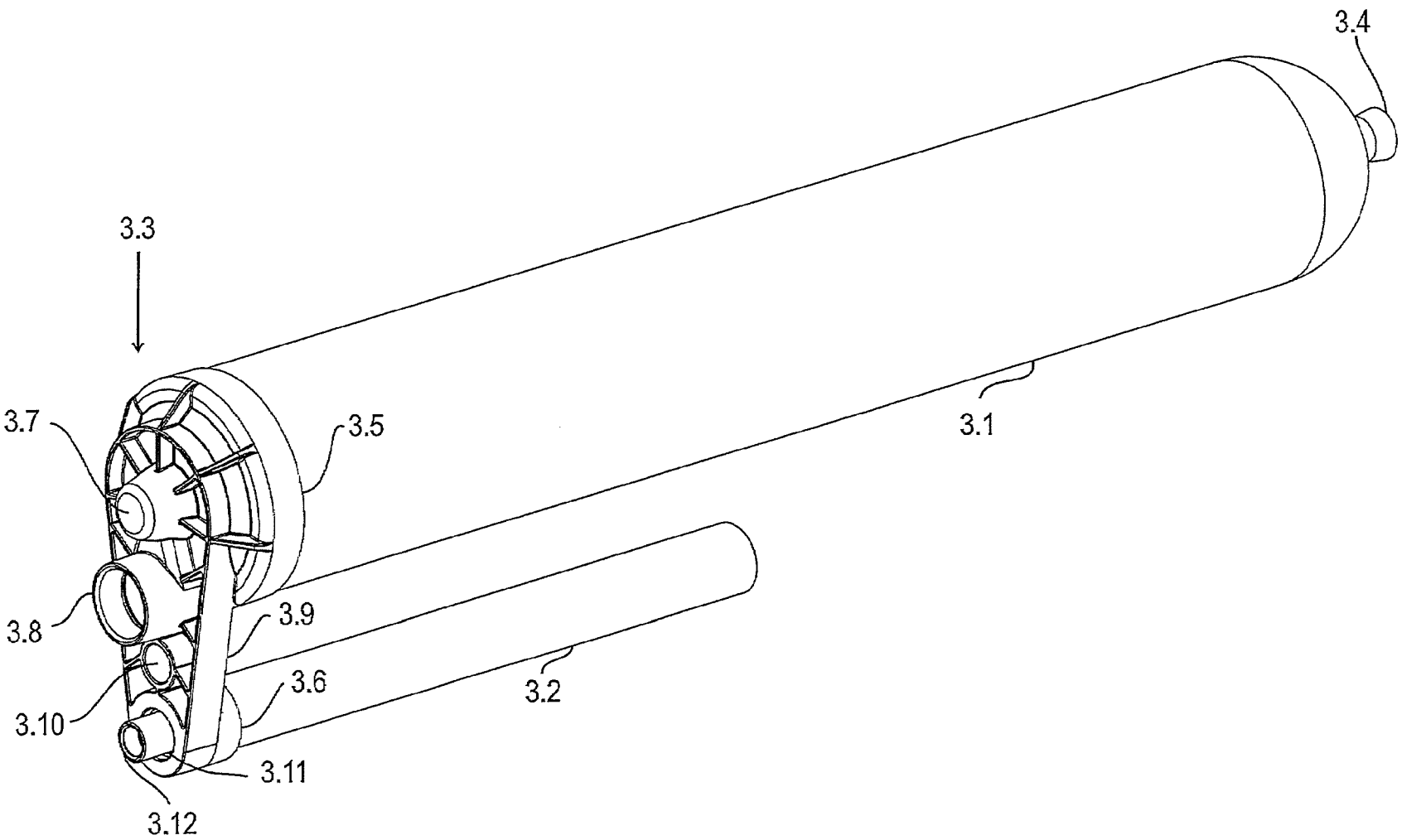
FIG. 6: shows an exemplary cartridge set for replenishing the application device with two substance components in two cartridges.

To provide a better understanding of the refill set, the set is shown again in an enlarged view in FIG. 6. It is composed of a first cartridge 3.1, which is designed as a foil pouch, and a closure piece 3.4 on each of the two sides. This foil pouch 3.1 is inserted on the front side thereof into a first receptacle 3.5 of the adapter 3.3, wherein this first receptacle 3.5 has a forwardly directed bulge 3.7, which provides space for the closure piece 3.4

The foil pouch 3.1 can thus be inserted into the first receptacle 3.5 without difficulty and without forming any unnecessary free spaces. It can, for example, be advantageous if the foil pouch 3.1 is additionally glued to the receptacle 3.5, so that the adapter 3.3 forms a unit together with the foil pouch 3.1. The adapter 3.3 also has a second receptacle 3.6, into which the cylindrical second cartridge 3.2 is inserted, wherein this receptacle 3.6 has a central opening 3.11 through which the discharge spout 3.12 of the cartridge 3.2 extends.

The two receptacles 3.5 and 3.6 are connected to each other by way of two ribs 3.9 and in the region between the receptacles 3.5 and 3.6 have an additional guidance with an aperture 3.10 for the drive shaft of an active mixer. It shall be pointed out that, according to the disclosure, the presence of this aperture 3.10 is optional, wherein a drive shaft is not required when a passive mixer is used.

In the embodiment shown here, as seen in the projection from the front, the centers of the outlet opening 3.8 for the substance component of the foil pouch 3.1 and of the discharge spout 3.12 of the second cartridge 3.2 and the center of the aperture 3.10 for a drive shaft of the mixer are thus located in one line. In addition, the center of the bulge 3.7 is likewise located on the same line.

Figure 7:
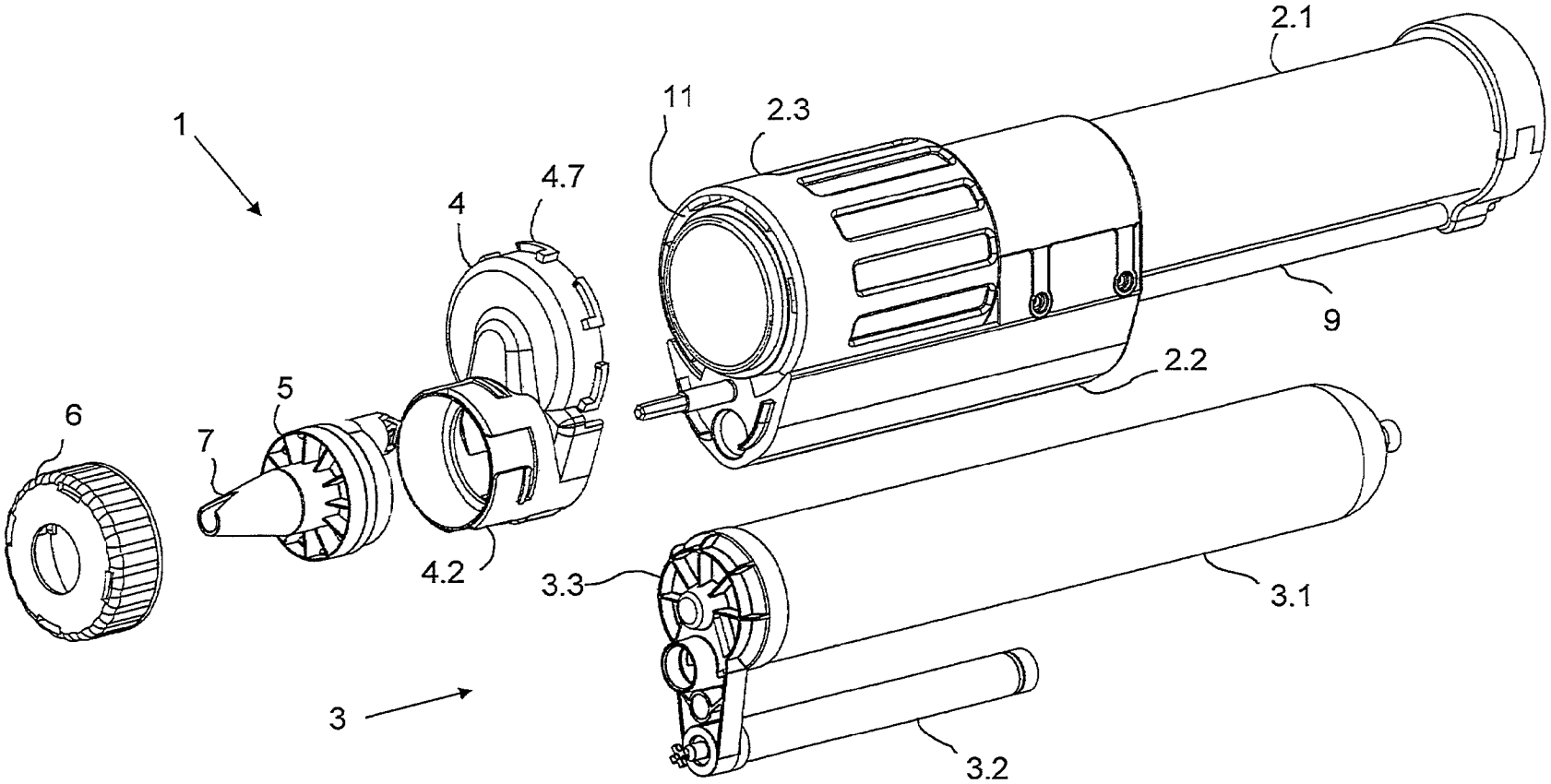
FIG. 7: shows an exemplary application device without drive, comprising a bayonet catch.

FIG. 7 shows an exemplary variant of the application device comprising a bayonet catch as briefly mentioned above, wherein, for the purpose of fastening to the cover adapter 2.3, the cartridge cover 4 comprises several integrally formed, L-shaped extensions 4.7, which are distributed over the circumference and which are able to engage with a bayonet catch mating piece 11 on the cover adapter 2.3. Apart from the slightly differently shaped and longer cartridge receiving device 2.2 for the cartridge 3.2, this embodiment otherwise essentially corresponds to the embodiments described above.

It shall be pointed out that, in such an application device, a drive device can also be provided in the known manner and can be operated by this drive device. For example, the drive device can be composed of at least one gearbox and an electric motor, which is connected thereto and responsible for the power operation of the entire gearbox.

So as to implement a basic inventive idea, exemplary embodiments encompass the following:

An application device for multi-component substances, comprising a plurality of cartridge receiving devices, an expulsion device for expelling the substance components from the cartridges in predetermined quantity ratios with the aid of expulsion pistons, and a mixing device, which mixes the expelled substance components and discharges them, wherein at least one of the cartridge receiving devices is designed to be loaded with cartridges on the discharge side, a cover adapter is provided on the discharge side on the at least two cartridge receiving devices, and a cartridge cover is provided, which is designed to receive or attach the replaceable mixing device.

A cartridge set therefor, comprising a first cartridge, a second cartridge, and an adapter piece having a first receptacle for the first cartridge, a second receptacle for the second cartridge, and at least one connecting rib between the first and second receptacles, wherein the first receptacle has an opening for an opening device of the foil pouch.

A packaging unit, composed of the above-mentioned application device and the above-mentioned cartridge set.

The feature combinations described hereafter appear to be particularly favorable:

I.a An application device for multi-component substances, in particular multi-component adhesives or multi-component sealants, comprising:

I.b at least two interconnected cartridge receiving devices for receiving replaceable cartridges containing substance components to be mixed, I.b an expulsion device for simultaneously expelling the substance components from the cartridges in predetermined quantity ratios through component outlets with the aid of expulsion pistons, I.c a mixing device, which is connected to the component outlets, mixes the expelled substance components and discharges them in the mixed state, wherein I.d at least one of the cartridge receiving devices is designed to be loaded with cartridges on the discharge side, I.e a cover adapter is provided on the discharge side on the at least two cartridge receiving devices, and I.f a cartridge cover is provided, which is designed to receive or attach the replaceable mixing device.

II. The application device according to the preceding feature combination I, wherein the mixing device is an active mixer.

III. The application device according to the preceding feature combination II, wherein a drive shaft is provided for the active mixer.

IV. The application device according to the preceding feature combination III, wherein the cover adapter has an aperture for the drive shaft to the active mixer.

V. An application device according to any one of the preceding feature combinations III to IV, wherein the cartridge cover has an aperture for the drive shaft to the active mixer.

VI. The application device according to the preceding feature combination I, wherein the mixing device is a passive mixer.

VII. An application device according to any one of the preceding feature combinations I to VI, wherein a closure bracket is provided, which fixes the cartridge cover after the cartridge cover has been placed on the cover adapter.

VIII. The application device according to the preceding feature combination VII, wherein the closure bracket comprises two swivel pins, which are hinged in the region of a cartridge receiving device.

IX. An application device according to any one of the preceding feature combinations I to VI, wherein a screw coupling is provided on the cover adapter, the coupling comprising a thread, which can engage with a mating thread, preferably a mating threaded segment, on the cartridge cover.

X. The application device according to the preceding feature combination IX, wherein the screw coupling comprises an external thread and the cartridge cover comprises an internal thread as the mating thread.

XI. An application device according to any one of the preceding feature combinations I to VI, wherein the cartridge cover is attached on the cover adapter so as to pivot about a swivel pin that is in particular parallel to the longitudinal axes of the cartridge receiving devices.

XII. The application device according to the preceding feature combination XI, wherein a shaft displacement element is provided, which can displace at least a part of the, optionally telescopic, drive shaft of an optionally present active mixer in the direction of the pin.

XIII. An application device according to any one of the preceding feature combinations I to VI, wherein the cartridge cover comprises several elastic claws and the cover adapter comprises at least one corresponding mating piece, so that the claws can latchingly engage with the cover adapter when the cartridge cover is placed on.

XIV. The application device according to the preceding feature combination XIII, wherein a closure sleeve is provided, which can be pushed over the claws so as to secure the connection between the cover adapter and cartridge cover.

XV. The application device according to the preceding feature combination XIV, wherein the elastic claws are designed with an outward bend with no load applied.

XVI. An application device according to any one of the preceding feature combinations I to VI, wherein the cover adapter is provided with a bayonet catch, which has an engagement section that can be pivoted about a rotational angle and can engage with a mating piece on the cartridge cover.

XVII. An application device according to any one of the preceding feature combinations I to XVI, wherein the cartridge cover comprises a mixer adapter in which the mixing device can be inserted and attached.

XVIII. The application device according to the preceding feature combination XVII, wherein a bayonet catch or turn lock is provided for fastening the mixing device.

XIX. A cartridge set for loading an application device for multi-component substances, in particular multi-component adhesives or multi-component sealants, in particular an application device according to the combination of features I.a to I.c or any one of the preceding feature combinations I to XVIII, wherein the cartridge set comprises:

XIX.a a first cartridge, composed of a foil pouch, and more particularly a substantially cylindrical foil pouch, containing a first substance component, XIX.b second cartridge, composed of a cylinder containing a second substance component, XIX.c and an adapter piece, XIX.d wherein the adapter piece comprises:

XIX.e a first receptacle for the first cartridge,

XIX.f a second receptacle for the second cartridge,

XIX.g at least one connecting rib between the first and second receptacles,

XIX.h wherein the first receptacle has an opening for an opening device of the foil pouch.

XX. The cartridge set according to the preceding feature combination XIX, wherein the adapter piece has an aperture for a drive shaft.

XXI. The cartridge set according to either one of the preceding feature combinations XIX or XX, wherein the second receptacle has a centrally located opening, through which a discharge spout of the second cartridge can be placed.

XXII. The cartridge set according to the preceding feature combination XXI, wherein, in a projection from the front, the centers of the opening for an opening device of the foil pouch, of the aperture for the drive shaft and the opening for the discharge spout of the second cartridge are arranged on a straight line.

XXIII. A cartridge set according to any one of the preceding feature combinations XIX to XXII, wherein the first receptacle has a central bulge, which provides room for a closure piece of the foil pouch.

XXIV. A packaging unit, composed of an application device for multi-component substances, in particular multi-component adhesives or multi-component sealants, according to the combination of features I.a to I.c or any one of the preceding feature combinations I to XVIII, and at least one cartridge set according to any one of the preceding feature combinations XIX to XXIII.

Thus, it will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

LIST OF REFERENCE NUMERALS

1 application device
2.1, 2.2 cartridge receiving device
2.3 cover adapter
2.4 shaft displacement element
2.5 mating piece
3 cartridge set
3.1 foil pouch/cartridge
3.2 cartridge having rigid outside wall
3.3 adapter
3.4 closure piece
3.5 first receptacle
3.6 second receptacle
3.7 bulge
3.8 opening
3.9 cartridge adapter/connecting rib
3.10 aperture
3.11 opening
3.12 discharge spout
4 cartridge cover
4.1 cover flange
4.2 mixer adapter
4.3 claws
4.4 closure sleeve

4.5 clip connection
4.6 internal thread
4.7 extension
5 mixing device
6 bayonet catch or turn lock
7 application tip
8 closure bracket
8.1, 8.2 swivel pins
9 drive shaft
10 screw coupling
10.1 external thread of screw coupling

What is claimed is:

1. An application device for a multi-component substance, comprising:

at least two interconnected cartridge receiving devices for receiving replaceable cartridges containing substance components to be mixed, one of the cartridges having a rigid outside wall;

a drive device for simultaneously expelling the substance components from cartridges in predetermined quantity ratios through component outlets with expulsion pistons;

a replaceable mixing device, which is connected to the component outlets, for mixing the expelled substance components and discharging them in a mixed state, wherein at least one of the cartridge receiving devices is configured to be loaded with cartridges on the discharge side; and wherein at least one of the cartridge receiving devices is configured with a rigid outside wall so as to mount a cartridge;

a cover adapter provided on the discharge side on the at least two cartridge receiving devices; and a cartridge cover that receives or attaches the mixing device.

2. The application device according to claim 1, wherein the cover adapter comprising:

a bayonet catch, which has an engagement section configured to be pivoted about a rotation angle, and to engage with a mating piece on the cartridge cover.

3. The application device according to claim 1, wherein the multi-component substance is a multi-component adhesive or multi-component sealant.

4. The application device according to claim 1, comprising:

a closure bracket, which fixes the cartridge cover after the cartridge cover has been placed on the cover adapter.

5. The application device according to claim 4, wherein the closure bracket comprises:

two swivel pins, which are hinged in a region of a cartridge receiving device.

6. The application device according to claim 1, wherein the cartridge cover is attached to the cover adapter so as to pivot about a swivel pin that is parallel to longitudinal axes of the cartridge receiving devices.

7. The application device according to claim 6, comprising:

a shaft displacement element which can displace at least a part of an optionally telescopic, drive shaft of an optional active mixer in a direction of the swivel pin.

8. The application device according to claim 1, wherein the cartridge cover comprises:

a mixer adapter, in which the mixing device can be inserted and attached.

9. The application device according to claim 8, comprising:

a bayonet catch or turn lock for attaching the mixing device.

10. The application device according to claim 1, wherein the cover adapter is provided with a screw coupling, which has a thread that can engage with a mating thread.

11. The application device according to claim 10, wherein the screw coupling comprises:

an external thread and the cartridge cover comprises an internal thread as the mating thread.

12. The application device according to claim 10, wherein the mating thread is a mating threaded segment.

13. The application device according to claim 1, wherein the cartridge cover comprises:

a plurality of elastic claws, and the cover adapter comprises:

at least one corresponding mating piece, so that the claws can latchingly engage with the cover adapter when the cartridge cover is placed on.

14. The application device according to claim 13, comprising:

a closure sleeve configured to be pushed over the claws so as to secure a connection between the cover adapter and the cartridge cover.

15. The application device according to claim 14, wherein the elastic claws are designed with an outward bend with no load applied.

16. A cartridge set for loading an application device for a multi-component substance, the cartridge set comprising:

a first cartridge, composed of a foil pouch containing a first substance component;

a second cartridge, composed of a cylinder having a rigid outside wall, containing a second substance component; and an adapter piece that is rigidly connected to the first and second cartridges, wherein the adapter piece comprises:

a first receptacle for the first cartridge;

a second receptacle for the second cartridge; and at least one connecting rib between the first and second receptacles;

wherein the first receptacle has an opening for an opening device of the foil pouch.

17. The cartridge set according to claim 16, wherein the foil pouch is substantially cylindrical.

18. A packaging unit, composed of an application device for a multi-component substance, comprising:

at least two interconnected cartridge receiving devices for receiving replaceable cartridges containing substance components to be mixed, one of the cartridges having a rigid outside wall;

a drive device for expelling the substance components from cartridges in predetermined quantity ratios through component outlets with expulsion pistons;

a replaceable mixing device, which is connected to the component outlets, for mixing the expelled substance components and discharging them in a mixed state, wherein at least one of the cartridge receiving devices is configured to be loaded with cartridges on the discharge side; and wherein at least one of the cartridge receiving devices is configured with a rigid outside wall so as to mount a cartridge;

a cover adapter provided on the discharge side on the at least two cartridge receiving devices;

a cartridge cover that receives or attaches the mixing device; and at least one cartridge set comprising:

a first cartridge, composed of a foil pouch containing a first substance component;

a second cartridge, composed of a cylinder having a rigid outside wall, containing a second substance component;

an adapter piece that is rigidly connected to the first and second cartridges, wherein the adapter piece comprises:

a first receptacle for the first cartridge;

a second receptacle for the second cartridge;

at least one connecting rib between the first and second receptacles; and wherein the first receptacle has an opening for an opening device of the foil pouch.

* * * * *